US005803789A

United States Patent [19]

Dean et al.

[11] Patent Number: 5,803,789

[45] Date of Patent: Sep. 8, 1998

[54] REMOTE CONTROL TOY INCLUDING TILT SWITCH HAND CONTROLLER

[76] Inventors: Bryan L. Dean, 145 Mountain View Manor, Torrington, Conn. 06790; Victor G. Reiling, 209 Sharon Rd., Lakeville, Conn. 06039; Loren T. Taylor, 822 Topsail La., Secaucus, N.J. 07094; Todd W. Wise, 11 Lafayette Rd., Barrington, R.I. 02806; Charles W. Miga, 15 Woodvine La., Exeter, R.I. 02822

[21] Appl. No.: 919,632

[22] Filed: Aug. 28, 1997

Related U.S. Application Data

[63] Continuation of Ser. No. 580,586, Dec. 29, 1995, abandoned.

[51] Int. Cl.[6] ..... A63H 17/39

[52] U.S. Cl. ..... 446/455; 446/175; 446/230; 446/462; 446/460

[58] Field of Search ..... 446/175, 230, 446/232, 454, 455, 456, 462

[56] References Cited

U.S. PATENT DOCUMENTS

| | | | |
|---|---|---|---|
| 2,943,855 | 7/1960 | Javna et al. | 446/7 |
| 3,101,569 | 8/1963 | Giardina . | |
| 3,314,189 | 4/1967 | Carroll | 446/175 |
| 3,394,906 | 7/1968 | Rogers | 446/48 |
| 4,695,266 | 9/1987 | Hui | 446/454 |
| 5,024,626 | 6/1991 | Robbins et al. | 446/454 |
| 5,094,646 | 3/1992 | Marceau | 446/456 |
| 5,127,658 | 7/1992 | Openiano | 446/7 |
| 5,158,495 | 10/1992 | Yonezawa | 446/456 |
| 5,507,455 | 4/1996 | Yang | 446/454 |

FOREIGN PATENT DOCUMENTS

| | | | |
|---|---|---|---|
| 2187650 | 9/1987 | United Kingdom | 446/456 |

*Primary Examiner*—Robert A. Hafer
*Assistant Examiner*—Jeffrey D. Carlson
*Attorney, Agent, or Firm*—Kurt R. Benson

[57] ABSTRACT

A remote control toy includes a remote land vehicle which is controlled by a hand controller configured in the shape of a flying vehicle. The hand controller includes a switch for controlling forward and rearward movement of the land vehicle and a photoelectric tilt switch for controlling steering of the land vehicle wherein tilting movement of the flying vehicle hand controller causes steering of the land vehicle. The tilting movement of the hand controller for steering creates that appearance that the flying vehicle is following or chasing the land vehicle.

11 Claims, 8 Drawing Sheets

REMOTE CONTROL TOY INCLUDING TILT SWITCH HAND CONTROLLER

This is a continuation of application Ser. No. 08/580,586, filed Dec. 29, 1995, now abandoned.

BACKGROUND AND SUMMARY OF THE INVENTION

The instant invention relates to remote control toys and more particularly to a remote control toy including a remote land vehicle, and a hand controller configured in the shape of a flying vehicle. The hand controller includes a tilt switch for controlling steering of the land vehicle wherein tilting movement of the hand controller causes steering of the land vehicle and thereby creates the appearance of a flying vehicle following or chasing a land vehicle.

Remote control toys have heretofore been known in the art. In this regard, the Giardina U.S. Pat. No. 3,101,569, and Hui U.S. Pat. No. 4,695,266 represent the closest prior art to the subject matter of the instant invention of which the applicant is aware.

The patent to Giardina discloses a remote control toy vehicle comprising a remote wheeled vehicle having a body configured in the shape of an airplane, and a hand controller configured in the shape of an airplane steering wheel for controlling movement of the remote toy airplane across a supporting surface. The rear wheels of the vehicle are driven by a reversible electric motor while the front wheel are normally free spinning. Steering of the vehicle is accomplished by applying friction to one or the other of the front wheels to prevent rotation thereof. Friction is applied to the wheels by respective solenoid assemblies which are independently actuable. The drive motor and solenoids are controlled by switches the hand controller. More specifically, forward and rearward movement, i.e. energizing of the drive motor, is controlled by independent push buttons on the hand controller. Actuation of the solenoids is controlled by a tilt switch mounted in the hand controller and comprising a rolling ball mounted inside a housing having internal contacts. Turning of the hand controller effects rolling of the ball and closure of the respective contacts for energizing the corresponding solenoid. Accordingly, rotation of the simulated steering wheel in a vertical plane effects turning of the toy airplane.

The patent to Hui discloses a remote control toy including a remote wheeled vehicle and a hand controller configured in the shape of a steering wheel for controlling movement of the vehicle across a supporting surface. The rear wheels of the vehicle are driven by a reversible electric motor while the front wheel are normally free spinning. The front wheels are pivotable for steering movement and are connected for concurrent movement through a steering linkage. Movement of the steering linkage is controlled by a reversible electric motor and associated gear system. The electric motor for the drive wheels is controlled by independent push button switches mounted on the steering wheel. The steering motor is controlled by a tilt switch arrangement mounted in the steering wheel wherein rotation of the wheel causes a pivoting contact element to pivot into communication with spaced contact pads. Accordingly, rotation of the simulated steering wheel effects turning of the toy vehicle.

While the above-described remote control toy vehicles are effective for their intended purpose, there is nevertheless a continuing need, and a consumer desire, for remote control vehicles having improved movement effects and configurations to enhance the play value of such toys. In this regard, the instant invention provides an improved remote control toy comprising a remote vehicle having a body configured in the shape of a land vehicle, preferably a car or truck, and a hand controller having a body configured in the shape of a flying vehicle, preferably a helicopter. The remote vehicle includes rear wheels, a reversible electric drive motor for reversibly driving the rear wheels, front wheels pivotally mounted to the front portion of the body, and electric actuator motor for actuating movement of the front wheels for steering of the remote vehicle. The remote control toy includes electric batteries mounted in the hand controller for energizing the electric drive motor and the electric actuator motor. For controlling operation of the electric drive motor and actuator motor, the hand controller includes a trigger switch assembly electrically connected to the batteries and the drive motor for selectively energizing the drive motor for forward and rearward rotation of the rear wheels, and further includes a tilt switch assembly electrically connected to the batteries and the actuator motor for selectively energizing the actuator motor for left and right steering of the front wheels.

In use, the trigger switch is operable for controlling forward and rearward movement of the vehicle by pressing the trigger lever forward and rearward while the tilt switch is operable when the trigger switch is engaged for controlling steering movements of the vehicle wherein tilting movement of the hand controller to the left and right causes concurrent steering of remote vehicle to the left and right. The tilting movements of the hand controller to effect steering are thus effective for simulating flying movements of a flying vehicle and thereby creating the appearance that the hand controller flying vehicle is chasing the remote land vehicle.

Accordingly, among the objects of the instant invention are the provision of an improved remote control toy vehicle; and more specifically, the provision of a remote control toy including a remote land vehicle, and a hand controller configured in the shape of a flying vehicle and including a tilt switch for controlling steering of the land vehicle wherein tilting movement of the flying vehicle causes steering of the land vehicle and also creates that appearance of the flying vehicle following or chasing the land vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
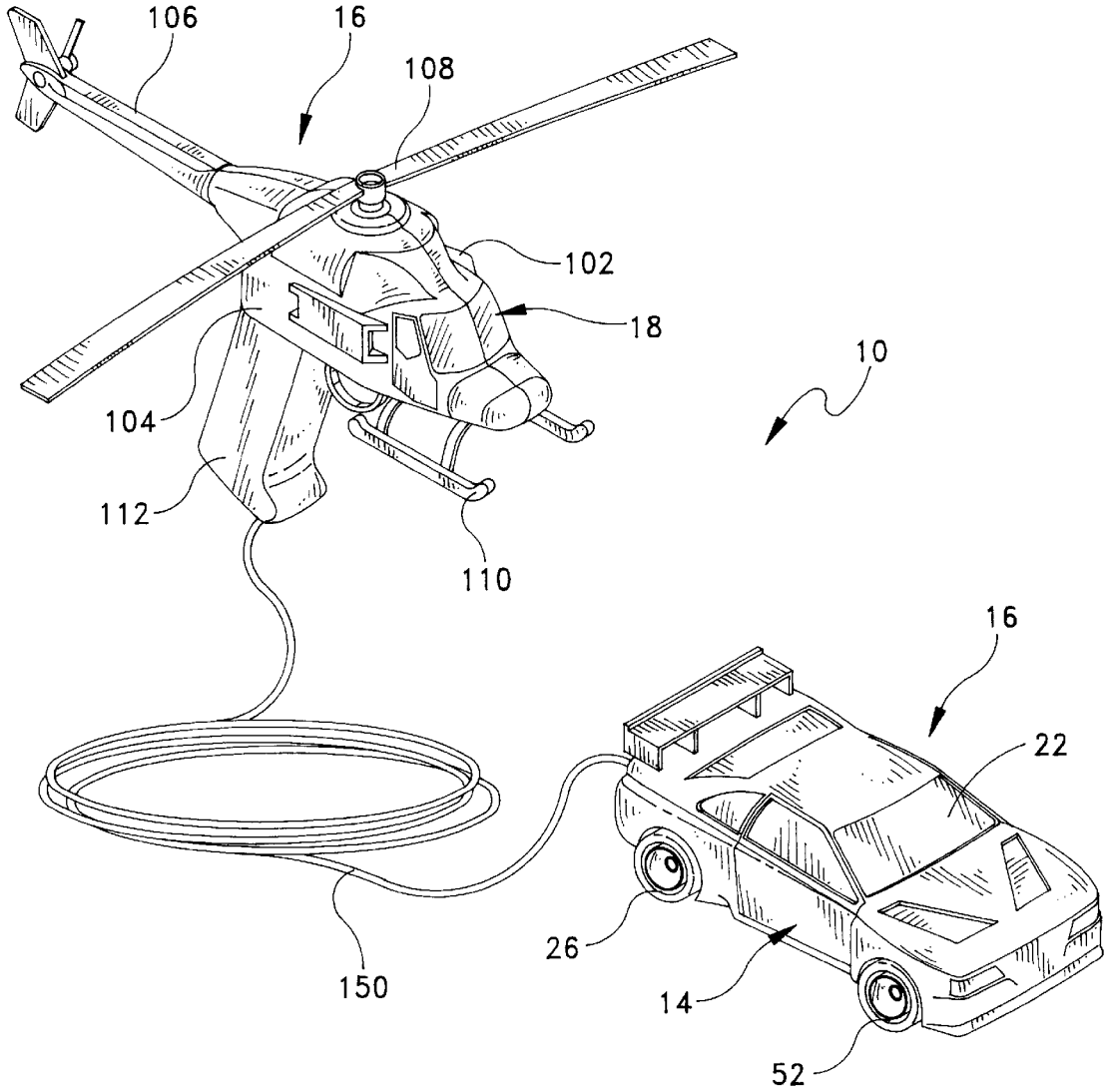
FIG. 1 is a perspective view of the remote control toy of the instant invention.
Figure 2:
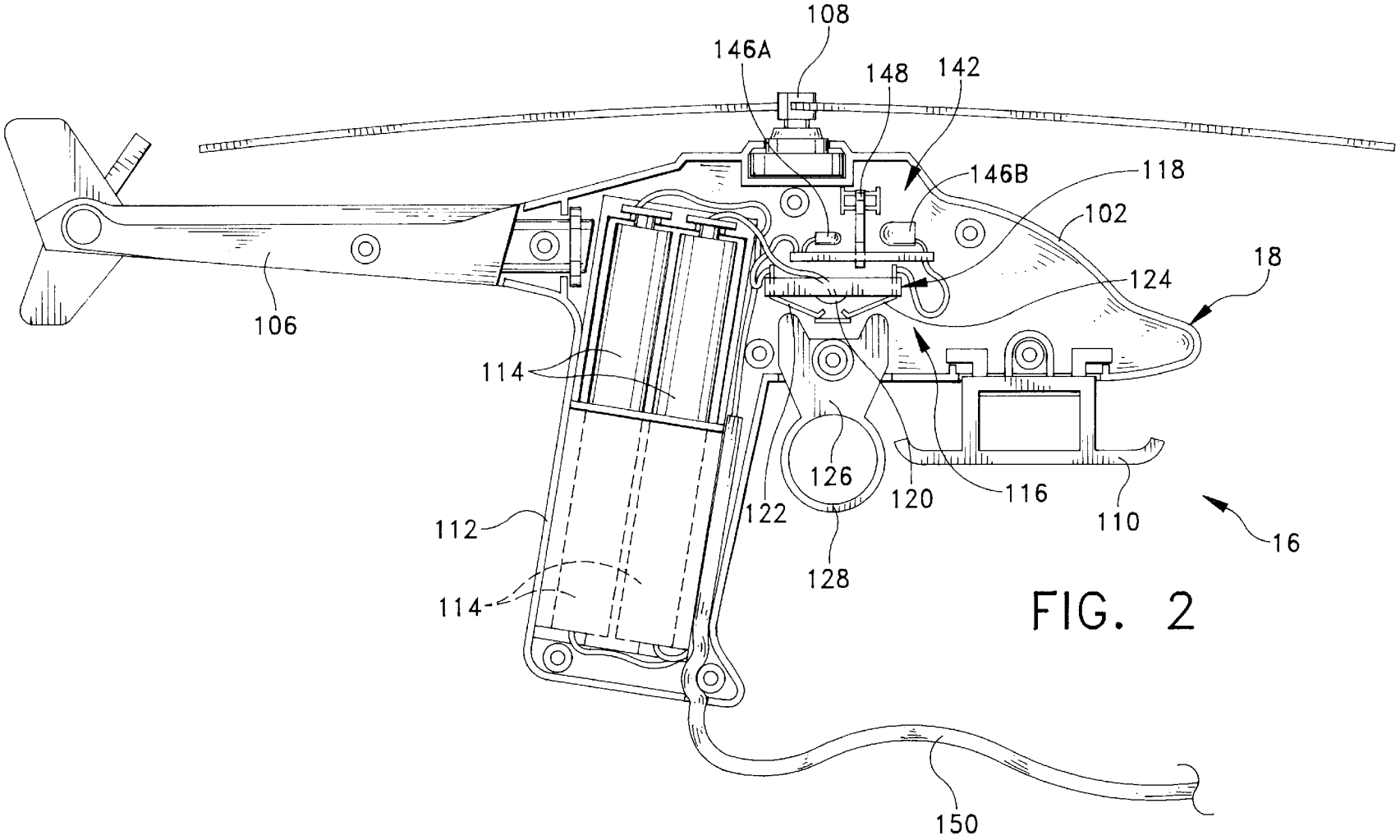
FIG. 2 is an elevational view of the left body portion of the hand controller.
Figure 3:
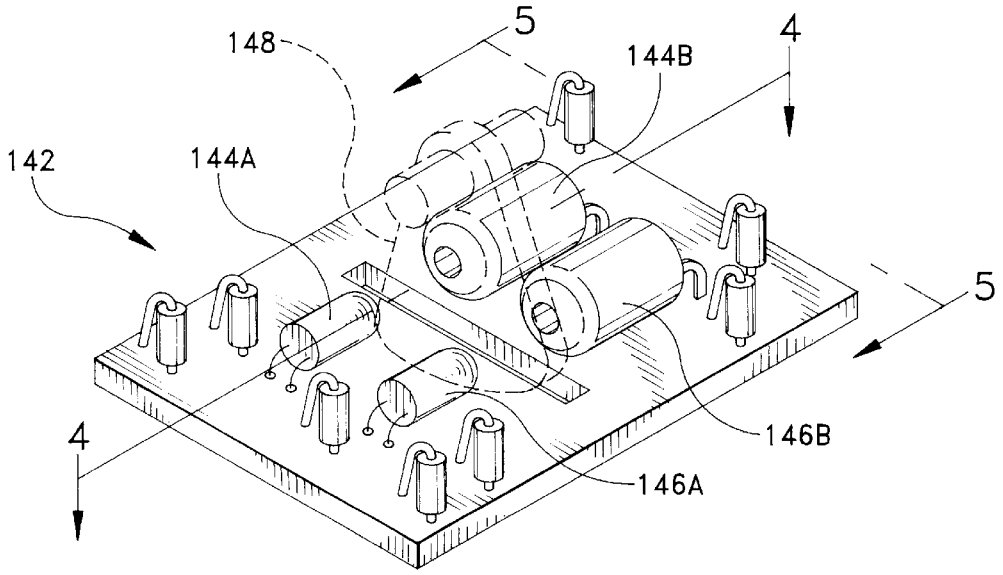
FIG. 3 is a perspective view of the tilt switch circuit assembly enclosed within the hand controller.
Figure 4:
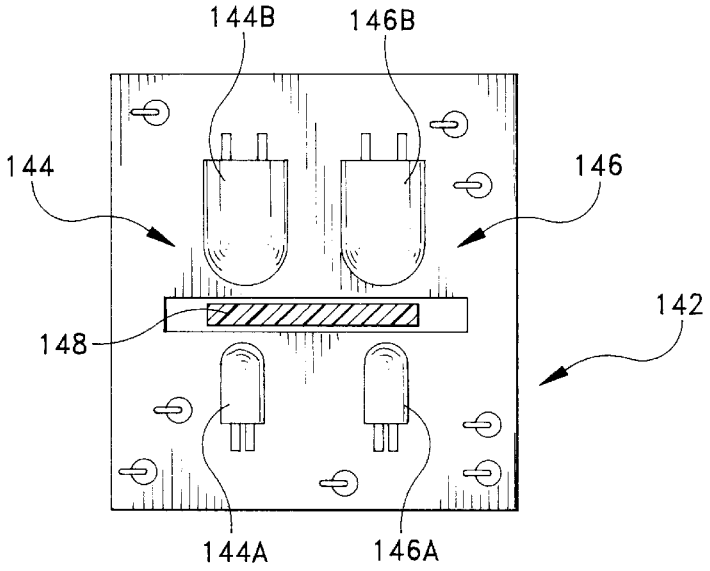
FIG. 4 is a cross-sectional view thereof as taken along line 4—4 of FIG. 3.
Figure 5:
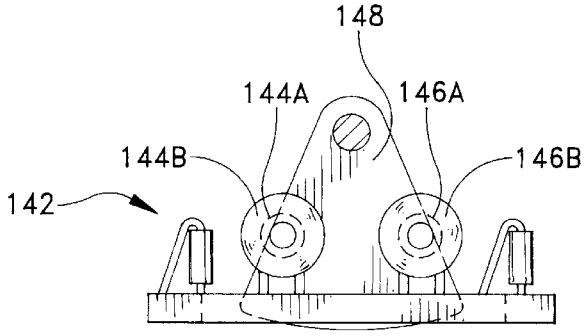
FIG. 5 is another cross-sectional view thereof as taken along line 5—5 of FIG. 3.
Figure 7:
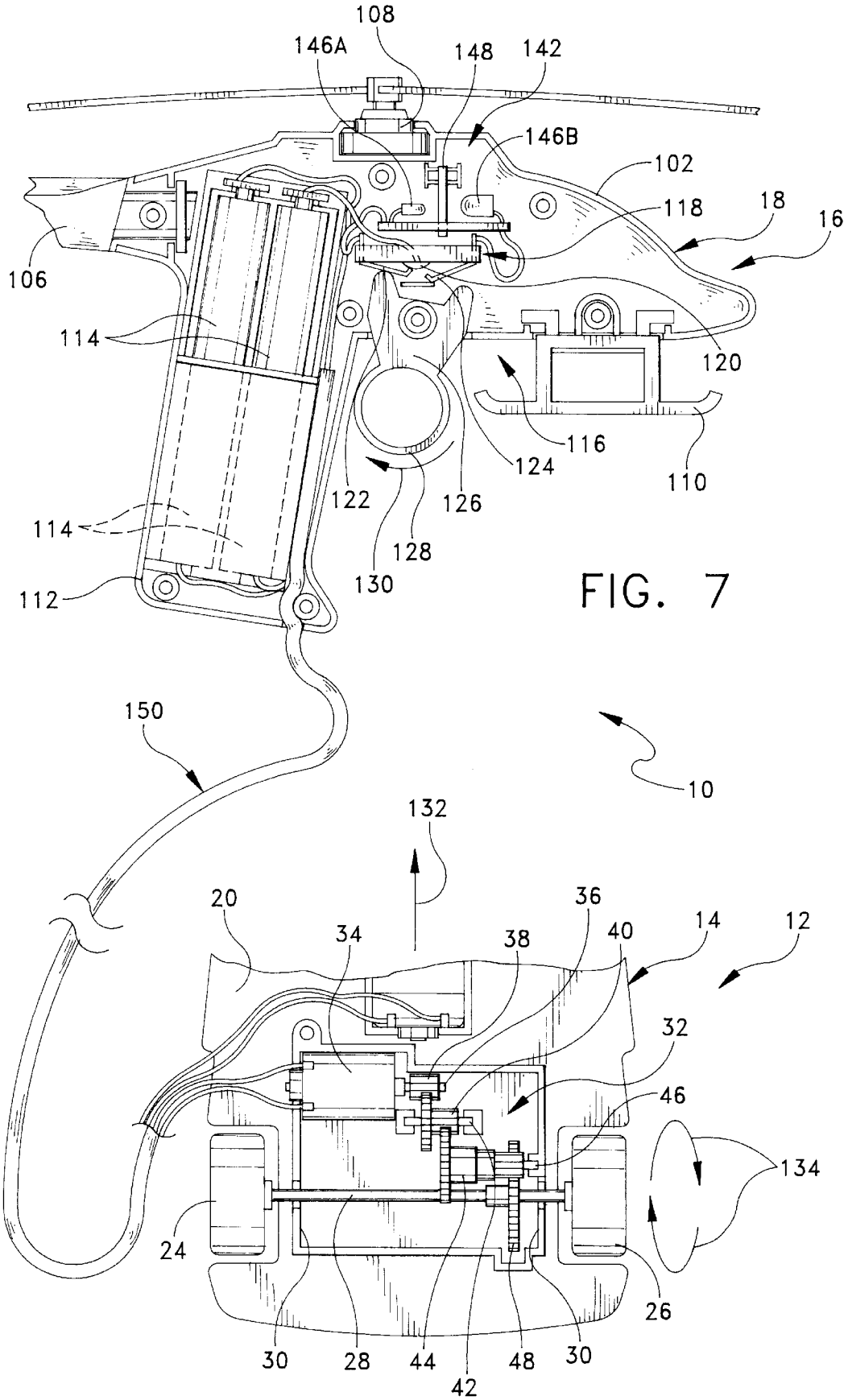
FIG. 7 is a combination of enlarged elevational views of the hand controller and the remote vehicle showing actuation of the trigger switch and associated movement of the rear drive train for forward movement of the remote vehicle.

Referring now to the drawings, the remote control toy of the instant invention is illustrated and generally indicated at 10 in FIGS. 1 and 7. As will hereinafter be more fully described, the instant remote control toy 10 includes a remote land vehicle and a hand controller configured in the shape of a flying vehicle. The hand controller includes a tilting switch mechanism for controlling steering of the land vehicle wherein tilting movement of the hand controller causes steering of the land vehicle and also creates that appearance of a flying vehicle following or chasing a land vehicle.

More specifically, the remote control toy 10 comprises a remote vehicle generally indicated at 12 having a body generally indicated at 14 configured in the shape of a land vehicle, preferably a wheeled car or truck as illustrated, and a hand controller generally indicated at 16 having a body generally indicated at 18 configured in the shape of a flying vehicle, preferably a helicopter.

The body 14 of the remote vehicle 12 includes a bottom chassis portion 20 and a top housing portion 22 which are received and secured in interfitting relation by fasteners (not shown). The remote vehicle 12 includes left and right rear wheels 24, 26 respectively mounted on a shaft 28 which passes through retaining walls 30 on the chassis portion 20 adjacent the rear of the body 14 for rotatably supporting the body 14 on a supporting surface. The remote vehicle 12 further comprises a reversible electric drive assembly generally indicated at 32 for reversibly drivably rotating the rear wheels 24, 26. The drive assembly 32 comprises a reversible electric motor 34 mounted to the chassis 20 and a gear train which couples the drive shaft 36 of the motor 34 to the wheel shaft 28. A drive gear 38 is mounted on the drive shaft 36 and engages with a first reduction gear 40 mounted on a shaft 42. The first reduction gear 42 engages with a second reduction gear 44 mounted on shaft 46 which in turn engages with a gear 48 mounted on the wheel shaft. The individual gears cooperate to transmit rotation of the drive shaft 36 to the wheel shaft 28.

Figure 6:
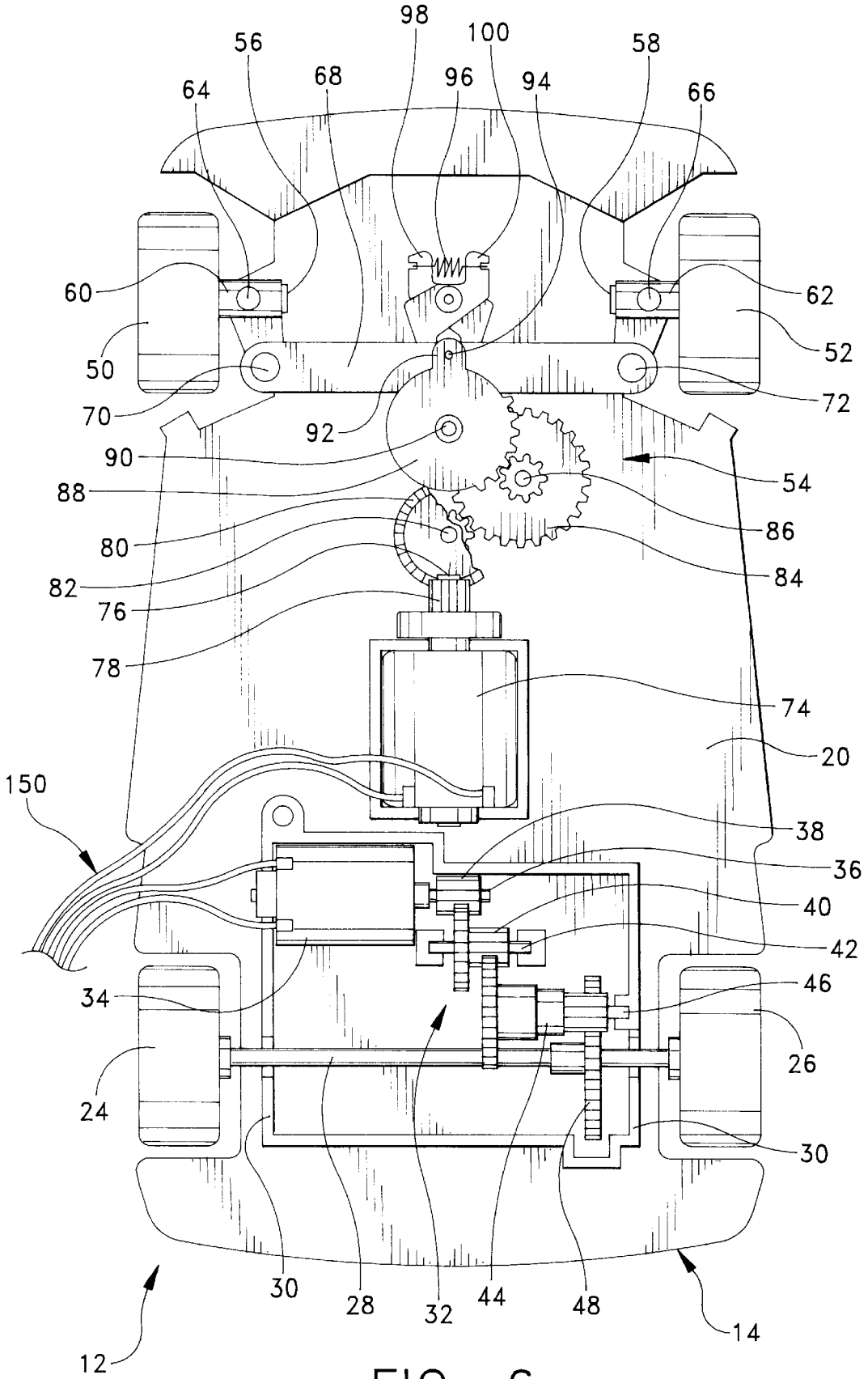
FIG. 6 is a top elevational view of the chassis portion of the remote vehicle.

The remote vehicle still further includes left and right front wheels 50, 52 respectively, and an electric actuator assembly generally indicated at 54 for actuating pivoting movement of the front wheels 50, 52 for steering of the remote vehicle 12. More specifically, the left and right front wheels 50, 52 are individually mounted on respective shafts 56, 58 which are enclosed within left and right shaft mounts 60, 62 respectively. The shaft mounts 60, 62 are pivotally mounted to the front portion of the chassis 20 by pins 64, 66. The shaft mounts. 60, 62 are linked together for concurrent movement by a steering link 68 which is pivotally connected to the shaft mounts by pins 70, 72. The electric actuator assembly 54 comprises a reversible electric motor 74 mounted to the chassis and a gear train which couples the drive shaft 76 of the motor 74 to the steering link 68. A drive gear 78 mounted on the drive shaft 76 intermeshes with a cup gear 80 mounted on shaft 82 which in turn intermeshes with a reduction gear 84 mounted on shaft 86. The reduction gear 84 intermeshes with the teeth of an actuator member 88 mounted on shaft 90. A projection 92 of the actuator member 88 is pivotally mounted by pin 94 to the steering link 68 for movement thereof. Accordingly, it can be seen that rotation of the drive shaft 76 causes concurrent turning of the front wheels 50, 52 for steering of the remote vehicle 12. The front wheels 50, 52 are normally biased to a central, i.e. straight ahead, position (FIG. 6) by means of a spring 96 secured between two pivoting levers 98, 100. The levers 98, 100 are actuated by a small arm (not shown) extending downwardly from the bottom of the steering link 68.

The body 18 of the hand controller 16 comprises left and right body portions 102, 104 respectively which are received and secured in interfitting relation by fasteners (not shown). The body 18 further includes a tail portion 106, a rotor portion 108 and landing rails 110 which are slidably received and captured between the left and right body portions 102, 104 when secured together. The body 18 further includes a handle section 112 in which a plurality of batteries 114 are housed for providing electrical energy to the electric motors 34 and 74 as described hereinabove.

Figure 8:
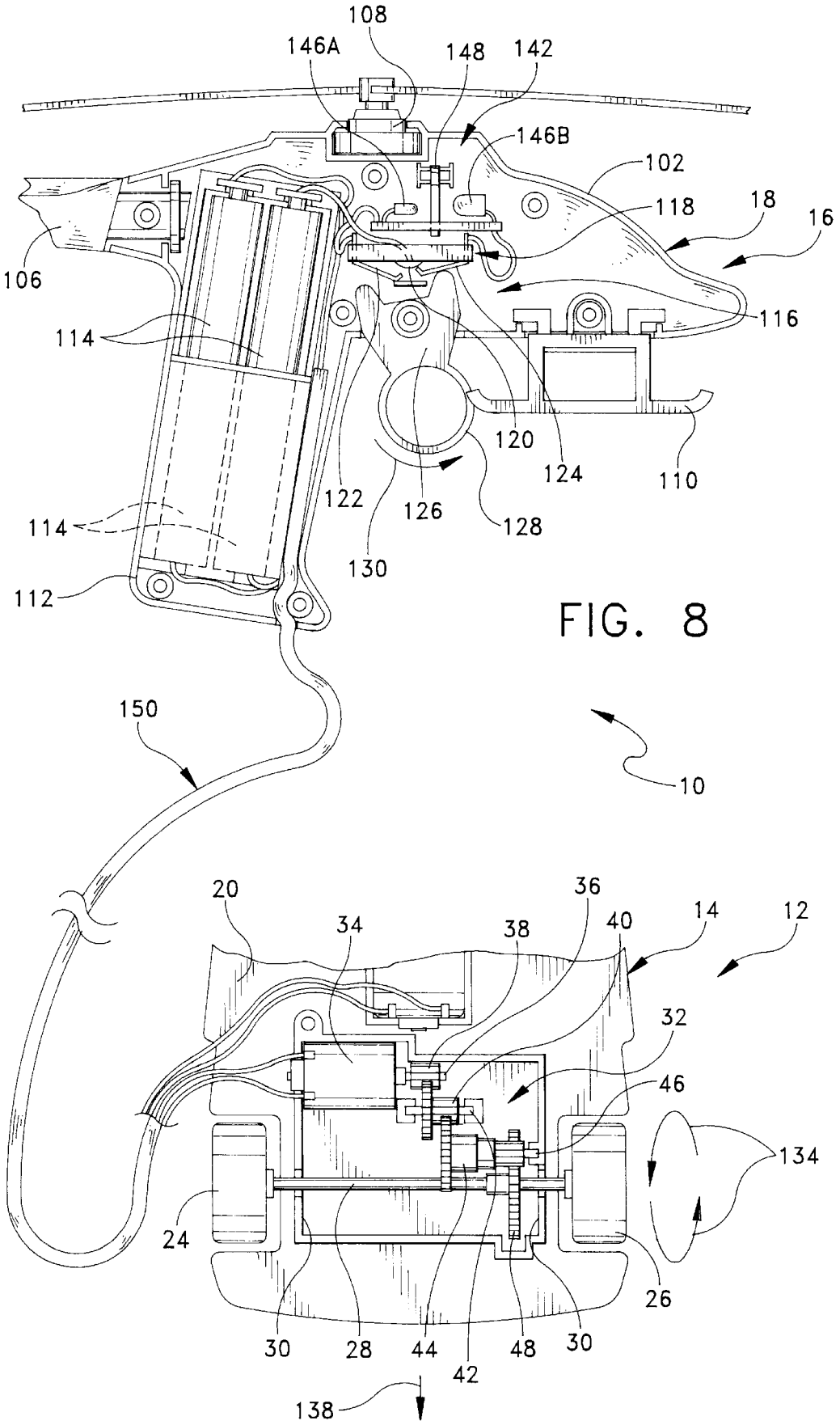
FIG. 8 is a similar view thereof showing actuation of the trigger switch for rearward movement of the remote vehicle.

The hand controller 16 includes a trigger switch assembly generally indicated at 116 electrically connected between the batteries 114 and the reversible electric drive motor 34 for selectively energizing the drive 34 for forward and rearward rotation of the rear wheels 24, 26. In this regard, the trigger switch assembly 116 comprises a dipole switch module generally indicated at 118 having a fixed contact 120, and first and second movable contacts 122, 124 respectively, and further comprises a trigger lever 126 pivotably mounted to the body 18 adjacent the handle 112. The trigger lever 126 is formed with an opening 128 for receiving the index finger of an operator when the operator grasps the handle 112 in a conventional manner. In operation, the trigger lever 126 is selectively pivotable forwardly and rearwardly for engaging and moving one of the first and second contacts 122, 124 into engagement with the fixed contact 120. Referring to FIG. 7, the trigger lever 126 is pivoted rearwardly (arrow 130) engaging the first contact 122 and the fixed contact 120 and causing forward movement (arrow 132) of the remote vehicle 12, i.e. clockwise rotation (arrows 134) of the rear wheels 24, 26. Referring to FIG. 8, the trigger lever 126 is pivoted forwardly (arrow 136) engaging the second contact 124 and the fixed contact 120 and causing rearward movement of the remote vehicle 12 (arrow 138), i.e. counterclockwise rotation (arrows 140) of the rear wheels 24, 26.

Figure 9:
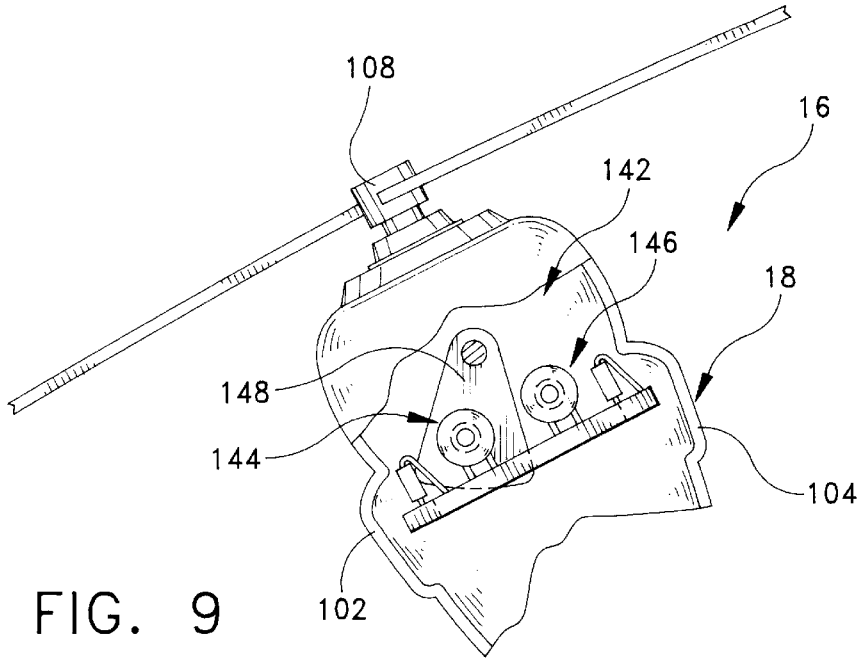
FIG. 9 is an enlarged fragmented rear view, partially in cross-section, of the hand controller showing tilting movement to the left and closure of the tilt switch for left turning of the remote vehicle.
Figure 10:
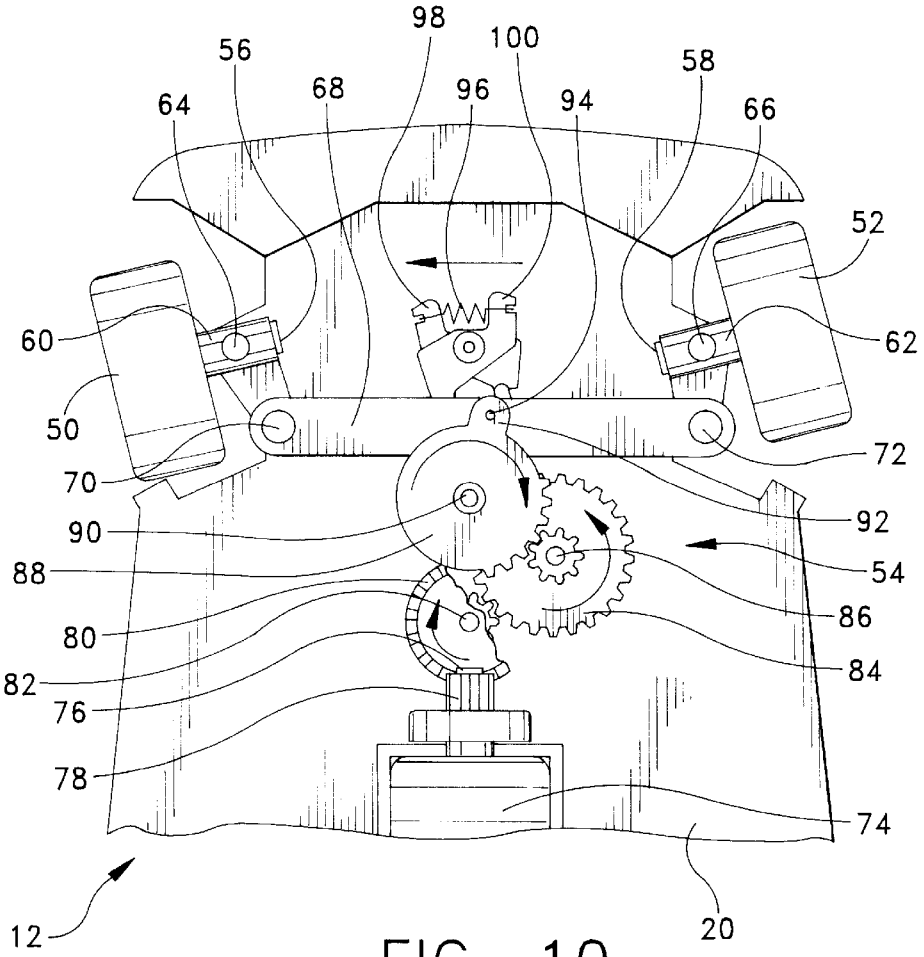
FIG. 10 is an enlarged top elevational view of the remote vehicle showing movement of the steering linkage as effected by movement of the hand controller as shown in FIG. 9.
Figure 11:
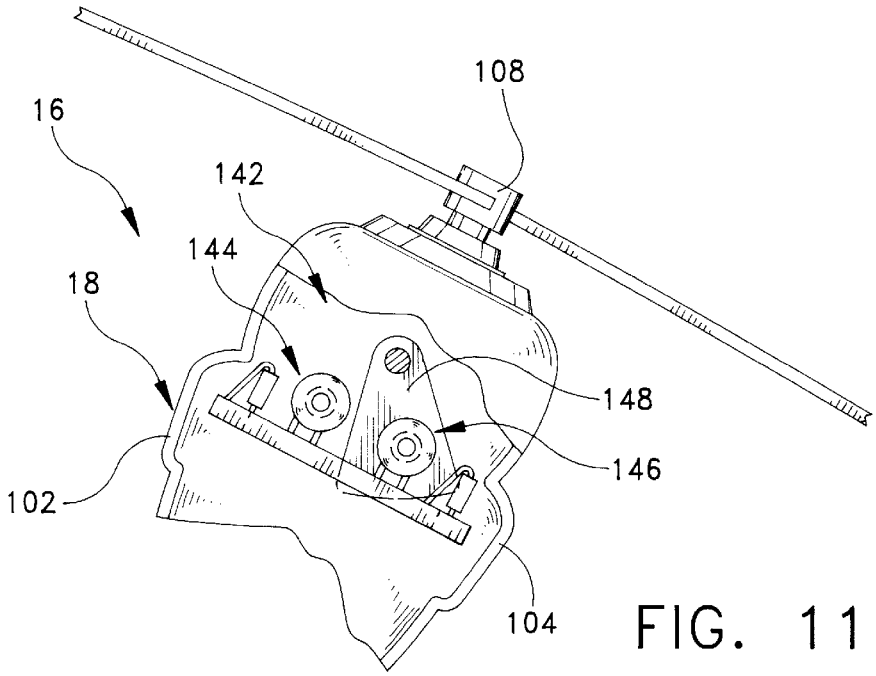
FIG. 11 is a enlarged fragmented rear view, partially in cross-section, of the hand controller showing tilting movement to the right and closure of the tilt switch for right turning of the remote vehicle.
Figure 12:
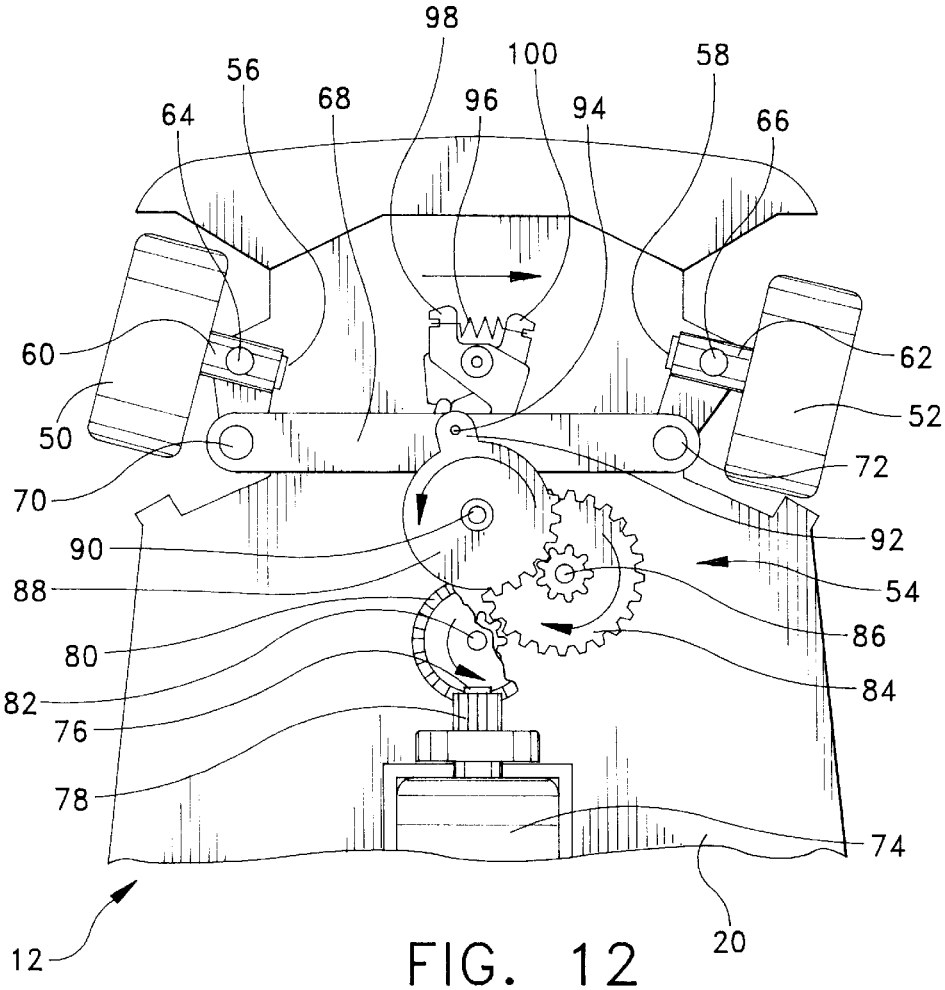
FIG. 12 is an enlarged top elevational view of the remote vehicle showing movement of the steering linkage as effected by movement of the hand controller as shown in FIG. 11.

The hand controller 16 further includes a tilt switch assembly generally indicated at 142 electrically connected between the batteries 114 and the electric motor 74 for selectively energizing the electric motor 74 for left and right steering of the front wheels 50, 52. Referring to FIGS. 2–5, the tilt switch assembly 142 comprises first and second photoelectric pairs generally indicated at 144, 146 respectively, mounted in side-by-side adjacent relation, each of the first and second photoelectric pairs 144, 146 including a light emitting diode 144A, 146A and a photoelectric sensor 144B, 146B mounted in spaced relation. The tilt switch assembly 142 further includes a pendulum 148 pivotally mounted in the body 18 for swinging movement within the space between the light emitting diodes 144A, 146A and the photoelectric detectors 144B, 146B wherein tilting movement of the hand controller 16 to one side causes the pendulum 148 to swing into a first position (FIG. 9) between the light emitting diode 144A and the photoelectric detector 144B of the first photoelectric pair 144, and tilting movement to the other side causes the pendulum 148 to swing into a second position (FIG. 11) between the light emitting diode 146A and the photoelectric detector 146B of the second photoelectric detector pair 146. In this manner of operation, the electric motor 74 is selectively energized for pivoting movement of the front wheels 50, 52 as seen in FIGS. 10 and 12 by selective opening and closing of the photoelectric detector pairs 144, 146. More specifically, when the pendulum 148 swings to one side, the light from one of the light emitting diodes is able to pass over to the corresponding photoelectric detector, triggering the detector, i.e. closing the switch for rotation of the electric motor 74 in the corresponding direction. Likewise, when the pendulum 148 swings to the opposite side, the other of the photoelectric pairs is triggered to rotate the electric motor 74 in the opposite direction.

The electrical connections between the batteries 114, contacts 120, 122, 124, photoelectric pairs 144, 146 and motors 34, 74 are accomplished by a wire set 150. The specific wiring connections necessary to accomplish to functions of the instant switches are well known to those skilled in the art, and thus will not be described in further detail.

In use, the trigger switch assembly 116 is operable for controlling forward and rearward movement of the remote vehicle 12 by pressing the trigger lever 126 forward and rearward (FIGS. 7 and 8), while the tilt switch assembly 142 is operable for controlling steering movements of the remote vehicle wherein tilting movement of the hand controller 16 to the left and right causes concurrent steering of remote vehicle 12 to the left and right. The tilting movements of the hand controller 16 are thus effective for simulating flying movements of a flying vehicle and thereby creating the appearance that the hand controller flying vehicle is chasing the remote land vehicle.

It can therefore be seen that the instant invention provides a novel and amusing remote control toy 10 which simulates a flying vehicle chasing a lend vehicle. The unique combination of a hand controller 16 configured in the shape of a flying vehicle and a tilt switch assembly 142 enclosed within the hand controller 16 to control turning of the associated remote vehicle 12 provides a novel and improved movement of the remote control toy 10 which has not been achieved by any prior art devices, and which is believed to provide an improved play value. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A remote control toy comprising:

a remote vehicle including a body configured in the shape of a land vehicle, a plurality of wheels on said body for movably said body on a supporting surface, a drive mechanism for rotating at least one of said wheels, and a steering mechanism for steering said remote vehicle; and a flying vehicle including a body portion configured in the shape of a body of a flying vehicle, said flying vehicle being of a type in which sharp turning movements during flight characteristically cause corresponding transverse titling movements thereof, said flying vehicle body having front and rear ends and opposite left and right sides, said flying vehicle body having a normal substantially horizontal flying attitude in which it is normally operative for traveling in a forward direction in a substantially horizontal plane, a hand controller attached to said flying vehicle and associated with said land vehicle, said hand controller including a first control mechanism selectively independently controlling said drive mechanism, a second control mechanism for selectively independently controlling steering of said land vehicle, said second control mechanism including a tilt mechanism wherein downward tilting movement of said flying vehicle embodied in said hand controller to the left or right from the normal attitude thereof causes concurrent steering of the land vehicle to the left or right, respectively, thereby creating the appearance that the flying vehicle is chasing the remote land vehicle, said flying vehicle further comprising a simulated propulsion mechanism.

2. In the remote control toy of claim 1, said flying vehicle comprising a simulated helicopter.

3. In the remote control toy of claim 1, said hand controller including a propeller to simulate a propeller driven flying vehicle.

4. A remote control toy comprising:

a remote vehicle including a body configured in the shape of a land vehicle, a plurality of wheels on said body for movably supporting said body on a supporting surface, a drive mechanism for rotating at least one of said wheels, and a steering mechanism for steering said remote vehicle; and a flying vehicle including a body portion configured in the shape of a body of a flying vehicle, said flying vehicle being of a type in which sharp turning movements during flight characteristically cause corresponding transverse titling movements thereof, said flying vehicle body having front and rear ends and opposite left and right sides, said flying vehicle body having a normal substantially horizontal flying attitude in which it is normally operative for traveling in a forward direction in a substantially horizontal plane, a hand controller attached to said flying vehicle and associated with said land vehicle, said hand controller including a first control mechanism selectively independently controlling said drive mechanism, a second control mechanism for selectively independently controlling steering of said land vehicle, said second control mechanism including a tilt mechanism wherein downward tilting movement of said flying vehicle embodied in said hand controller to the left or right from the normal attitude thereof causes concurrent steering of the land vehicle to the left or right, respectively, thereby creating the appearance that the flying vehicle is chasing the remote land vehicle, said flying vehicle body being uninterrupted between the front and rear ends thereof and being of noncircular configuration in plan view when said flying vehicle is in the normal horizontal attitude thereof such that said flying vehicle body includes front and rear ends of structurally different and distinct configurations.

5. A remote control toy comprising:

a remote vehicle including a body configured in the shape of a land vehicle, a plurality of wheels on said body for movably supporting said body on a supporting surface, a drive mechanism for rotating at least one of said wheels, and a steering mechanism for steering said remote vehicle; and a flying vehicle including a body portion configured in the shape of a body of a flying vehicle, said flying vehicle being of a type in which sharp turning movements during flight characteristically cause corresponding transverse titling movements thereof, said flying vehicle body having front and rear ends and opposite left and right sides, said flying vehicle body having a normal substantially horizontal flying attitude in which it is normally operative for traveling in a forward direction in a substantially horizontal plane, a hand controller attached to said flying vehicle and associated with said land vehicle, said hand controller including a first control mechanism selectively independently controlling said drive mechanism, a second control mechanism for selectively independently controlling steering of said land vehicle, said second control mechanism including a tilt mechanism wherein downward tilting movement of said flying vehicle embodied in said hand controller to the left or right from the normal attitude thereof causes concurrent steering of the land vehicle to the left or right, respectively, thereby creating the appearance that the flying vehicle is chasing the remote land vehicle, said hand controller further comprising a handle element on said body portion, said handle element depending from said body portion when said body portion is in the normal horizontal attitude thereof.

6. A remote control toy comprising:

a remote vehicle including a body configured in the shape of a land vehicle, a plurality of wheels on said body for movably supporting said body on a supporting surface, a drive mechanism for rotating at least one of said wheels, and a steering mechanism for steering said remote vehicle; and a flying vehicle including a body portion configured in the shape of a body of a flying vehicle, said flying vehicle being of a type in which sharp turning movements during flight characteristically cause corresponding transverse titling movements thereof, said flying vehicle body having front and rear ends and opposite left and right sides, said flying vehicle body having a normal substantially horizontal flying attitude in which it is normally operative for traveling in a forward direction in a substantially horizontal plane, a hand controller attached to said flying vehicle and associated with said land vehicle, said hand controller including a first control mechanism selectively independently controlling said drive mechanism, a second control mechanism for selectively independently controlling steering of said land vehicle, said second control mechanism including a tilt mechanism wherein downward tilting movement of said flying vehicle embodied in said hand controller to the left or right from the normal attitude thereof causes concurrent steering of the land vehicle to the left or right, respectively, thereby creating the appearance that the flying vehicle is chasing the remote land vehicle, said body portion being configured in the shape of a longitudinally elongated body of a flying vehicle.

7. A remote control toy comprising:

a remote vehicle including a body configured in the shape of a land vehicle, a plurality of wheels mounted to said body for movably supporting said body on a supporting surface, a drive mechanism for rotating at least one of said wheels, and a steering mechanism for steering said remote vehicle;

a flying vehicle including a body portion configured in the shape of a body of a flying vehicle, said flying vehicle having front and rear ends and opposite left and right sides, said flying vehicle body having a normal substantially horizontal flying attitude in which it is normally operative for traveling in a forward direction in a substantially horizontal plane, said flying vehicle body being uninterrupted between the front and rear ends thereof and being of noncircular configuration in plan view when said flying vehicle body is in the normal horizontal attitude thereof such that said flying vehicle body includes front and rear ends of structurally different and distinct configurations; and a controller attached to said flying vehicle and including a first control mechanism for selectively independently controlling said drive mechanism, a second control mechanism for selectively independently controlling steering of said vehicle, said second control mechanism including a tilt mechanism wherein downward tilting movement of said flying vehicle embodied in said hand controller to the left or right from the normal attitude thereof causes concurrent steering of the land vehicle to the left or right, respectively, thereby creating the appearance that the flying vehicle is chasing the remote land vehicle.

8. A remote control toy comprising:

a land vehicle including a body configured in the shape of a land vehicle, a plurality of wheels for movably supporting said land vehicle on a supporting surface, an electric drive assembly for reversibly propelling said land vehicle on said supporting surface, and a steering mechanism for steering said land vehicle on said supporting surface;

a flying vehicle including a body portion configured in the shape of a flying vehicle, said flying vehicle having front and rear ends and left and right sides and having a normal substantially horizontal flying attitude in which said flying vehicle is normally operative for traveling in a forward direction in a substantially horizontal plane, said flying vehicle being of a type in which sharp turning movements during flight characteristically cause corresponding transverse titling movements thereof;

a hand controller physically connected to said flying vehicle for movement therewith and operatively associated with said land vehicle for controlling the operations of said land vehicle, said hand controller including a drive control associated with said land vehicle for controlling said electric drive assembly for selectively operating said land vehicle in forward and rearward directions on said supporting surface and a tilt control for selectively controlling the operation of said steering mechanism for steering said land vehicle on said supporting surface, said tilt control being operative such that downward tilting of said hand controller to the left or right as associated with downward titling of said flying vehicle to the left or right, respectively, from the normal attitude thereof causes corresponding steering of said land vehicle to the left or right, respectively, thereby creating the appearance that said flying vehicle is chasing said land vehicle, said flying vehicle further comprising a simulated propulsion mechanism on said flying vehicle body.

9. In the remote control toy of claim 8, said simulated propulsion mechanism including a propeller to simulate a propeller driven flying vehicle.

10. In the remote control toy of claim 8, said flying vehicle comprising a simulated helicopter.

11. A remote control toy comprising:

a land vehicle including a body configured in the shape of a land vehicle, a plurality of wheels for movably supporting said land vehicle on a supporting surface, an electric drive assembly for reversibly propelling said land vehicle on said supporting surface, and a steering mechanism for steering said land vehicle on said supporting surface;

a flying vehicle including a body portion configured in the shape of a flying vehicle, said flying vehicle having front and rear ends and left and right sides and having a normal substantially horizontal flying attitude in which said flying vehicle is normally operative for traveling in a forward direction in a substantially horizontal plane, said flying vehicle being of a type in which sharp turning movements during flight characteristically cause corresponding transverse titling movements thereof;

a hand controller physically connected to said flying vehicle for movement therewith and operatively associated with said land vehicle for controlling the operations of said land vehicle, said hand controller including a drive control associated with said land vehicle for controlling said electric drive assembly for selectively operating said land vehicle in forward and rearward directions on said supporting surface and a tilt control for selectively controlling the operation of said steering mechanism for steering said land vehicle on said supporting surface, said tilt control being operative such that downward tilting of said hand controller to the left or right as associated with downward titling of said flying vehicle to the left or right, respectively, from the normal attitude thereof causes corresponding steering of said land vehicle to the left or right, respectively, thereby creating the appearance that said flying vehicle is chasing said land vehicle, said flying vehicle body being of longitudinally elongated configuration.

* * * * *